US005205791A

United States Patent [19]

Pledger

[11] Patent Number: 5,205,791

[45] Date of Patent: Apr. 27, 1993

[54] PORTABLE SANDBOX

[76] Inventor: Frances E. Pledger, 1608 W. Gulfport St., Broken Arrow, Okla. 74011

[21] Appl. No.: 836,983

[22] Filed: Feb. 14, 1992

[51] Int. Cl.[5] ..... A63G 31/00

[52] U.S. Cl. ..... 472/126; 4/488; 4/506

[58] Field of Search ..... 472/126; 4/488, 494, 4/495, 506, 513

[56] References Cited

U.S. PATENT DOCUMENTS

| | | | |
|---|---|---|---|
| 1,744,079 | 1/1930 | Phillips | 472/126 |
| 1,865,810 | 7/1932 | Albach | 472/126 |
| 1,961,061 | 5/1934 | McCulloch . | |
| 2,479,203 | 8/1949 | Brown . | |
| 2,483,789 | 10/1949 | Smith . | |
| 2,491,036 | 12/1949 | Dodge . | |
| 2,529,951 | 11/1950 | Kaye | 472/126 X |
| 2,580,942 | 1/1952 | Murad . | |
| 2,628,364 | 2/1953 | Wallace . | |
| 2,815,512 | 12/1957 | Meekin et al. | 472/126 X |
| 2,839,762 | 6/1958 | Nomura . | |
| 4,500,129 | 2/1985 | Hahn . | |
| 4,559,652 | 12/1985 | Uchitelle . | |
| 4,738,545 | 4/1988 | Westgor . | |
| 4,811,437 | 3/1989 | Dillner . | |
| 4,856,912 | 8/1989 | Damus . | |
| 4,935,970 | 6/1990 | Aristone . | |
| 4,991,978 | 2/1991 | Ostrowski . | |
| 4,999,863 | 3/1991 | Kane . | |

*Primary Examiner*—Richard E. Chilcot, Jr.
*Attorney, Agent, or Firm*—Head & Johnson

[57] ABSTRACT

A sandbox provided for indoor use consists of a sheet of fabric-like material having a collapsible wall about its perimeter such that, when the sheet is smoothed into a substantially flat horizontal condition, the collapsible wall stands in substantially vertical relation along the perimeter of the sheet. Thus, the smoothed out sheet and the vertical wall define a contained play area to hold sand. Preferably, the wall is formed of sections of a cushion-like material such as foam rubber covered by material such as that used to form the horizontal sheet. Thus the wall would be collapsible along the vertical folds defined at the junctions of the covered foam rubber sections. Interior to the perimeter of the sandbox, the upper surface of the sheet is fitted with a gathering mechanism, typically a drawstring laid out in circular fashion on the top surface of the sheet with a circular stretch of material covering the drawstring and fixed to the sheet.

21 Claims, 3 Drawing Sheets

PORTABLE SANDBOX

BACKGROUND OF THE INVENTION

This invention relates generally to children's play equipment and more particularly concerns sandboxes and the like.

From toddler age to early teens, children love to play in the sand. Whether they are building castles or cities, or just enjoying wiggling their fingers and toes, beaches and sandboxes provide seemingly endless entertainment for them. If the beach or the sandbox could be brought indoors, hours of entertainment and education could be regained.

Few homes, however, can afford the interior space to maintain a sandbox. Even if they could, the messy image conjured by such an arrangement dissuades most parents from the attempt.

It is, therefore, an object of this invention to provide an indoor sandbox which does not place a constant demand on the space limitations of the house. It is also an object of this invention to provide a sandbox that minimizes the "messy" characteristics generally associated with sandboxes.

SUMMARY OF THE INVENTION

In accordance with the invention, a sandbox is provided for indoor use which consists of a sheet of fabric-like material having a collapsible wall about its perimeter such that, when the sheet is smoothed into a substantially flat horizontal condition, the collapsible wall stands in substantially vertical relation along the perimeter of the sheet. Thus, the smoothed out sheet and the vertical wall define a contained play area to hold sand. Preferably, the wall would be formed of sections of a cushion-like material such as foam rubber covered by material such as that used to form the horizontal sheet. Thus the wall would be collapsible along the vertical folds defined at the junctions of the covered foam rubber sections. Interior to the perimeter of the sandbox, the upper surface of the sheet is fitted with a gathering mechanism, typically a drawstring laid out in circular fashion on the top surface of the sheet with a circular stretch of material covering the drawstring and fixed to the sheet. Thus, sand and toys lying within the sandbox can be shifted toward the center of the gathering mechanism by lifting the perimeter of the sandbox above the horizontal. With the sand and toys shifted within the drawstring circle, the drawstring is pulled to close the gathering mechanism and secure the sand and toys within the storage pouch formed by the portion of the sheet lying interior to the gathering mechanism. When the sand and toys are collected toward the center of the sandbox and the drawstring pulled to gather the interior of the sheet into a containing pouch, the collapsing exterior wall readily folds into a compact condition so that the entire sandbox including the wall, the playing surface, the sand and the toys can be placed in a suitable duffle bag and stored for future use.

In a preferred embodiment, all of the components are machine washable, perhaps nylon. Furthermore, the sand itself would preferably be a washable synthetic imitation. For really young toddlers, it is anticipated that the sand or its substitute be nontoxic and perhaps even edible, such as cheerios or oatmeal or the like.

BRIEF DESCRIPTION OF THE DRAWINGS

Other objects and advantages of the invention will become apparent upon reading the following detailed description and upon reference to the drawings in which.

Thus, it is apparent that there has been provided, in accordance with the invention, a portable sandbox that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

DETAILED DESCRIPTION OF THE INVENTION

Figure 1:
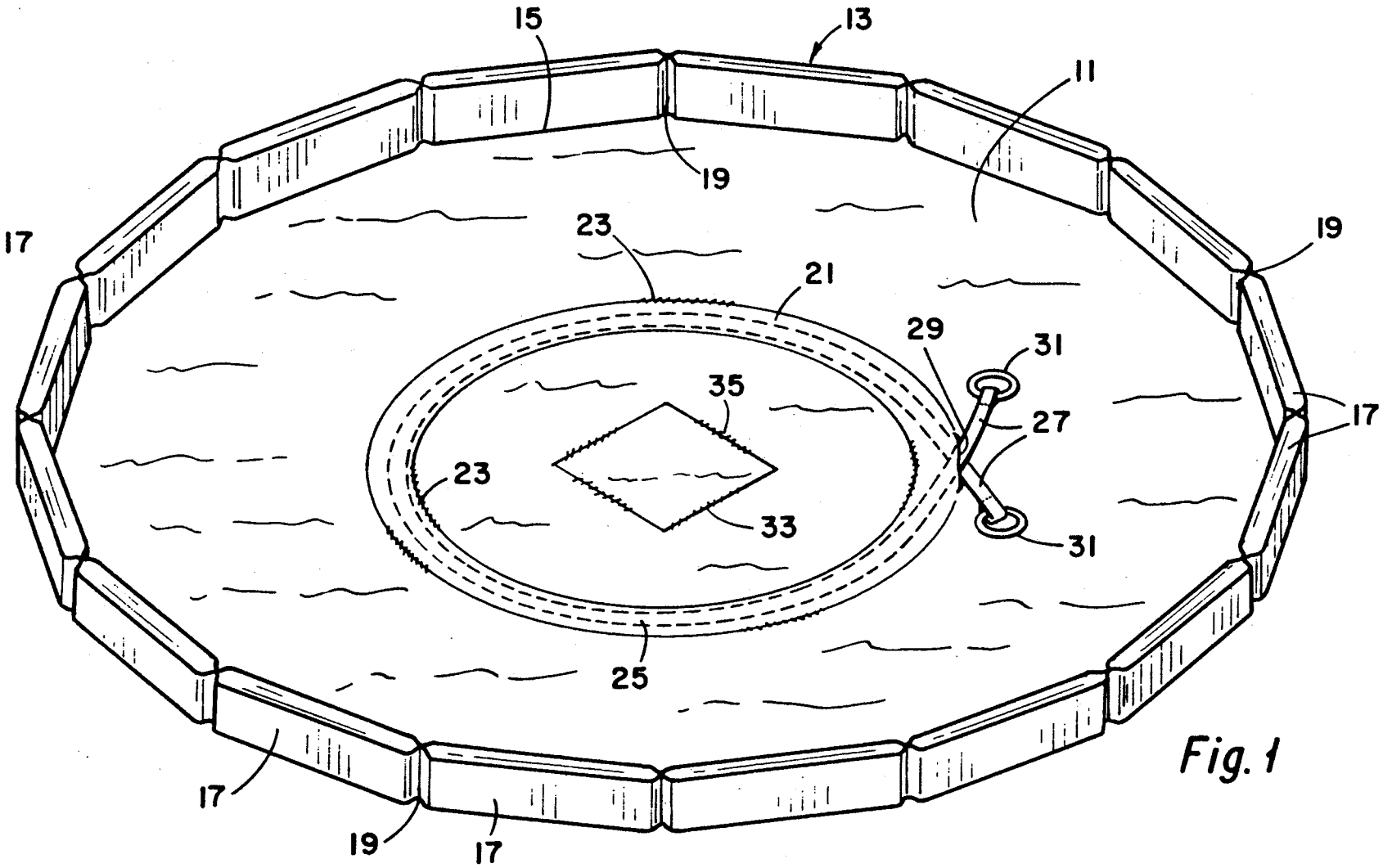
FIG. 1 is a perspective view illustrating a preferred embodiment of the portable sandbox laid out in a ready-for-play condition.

Turning first to FIG. 1, a preferred embodiment of the portable sandbox is illustrated in which a circular, fabric-like sheet 11 laid out in a substantially flat, horizontal condition is surrounded by an endless wall 13 having its bottom edge 15 fixed along the perimeter of the sheet 11. Corresponding distances across any vertically spaced planes passing through the wall 13 are substantially the same as the corresponding distance across the sheet 11, so that when the sheet 11 is fully spread, the wall 13 tends to stand in vertical relationship to the sheet 11.

In the preferred embodiment shown, the wall consists of a plurality of rectangular members 17 joined in end-to-end fashion at a plurality of vertical folds 19. The rectangular members may be formed of panels of foam rubber or the like encased in a fabric-like material similar to the material used in the sheet 11 and stitched or otherwise joined together at the folds 19 so as to provide a hinge-like connection between the panels 17. As is also shown in reference to this preferred embodiment, the sandbox includes a circular strip of material 21 secured to the top surface of the sheet 11 in concentric relation to the perimeter of the sheet 11. The strip 21 may be fastened at its edges by stitching 23 or any other suitable means. Disposed between the top surface of the sheet 11 and the circular strip 21 is a drawstring 25 having ends 27 which extend out from beneath the circular strip 21 at an open segment 29. The ends 27 of the drawstring 25 are provided with grips 31 to facilitate the operation of the drawstring. The sandbox may also include a centrally disposed reinforcing segment 33 secured to the sheet 11 by stitching 35 or other suitable fastening means.

Figure 2:
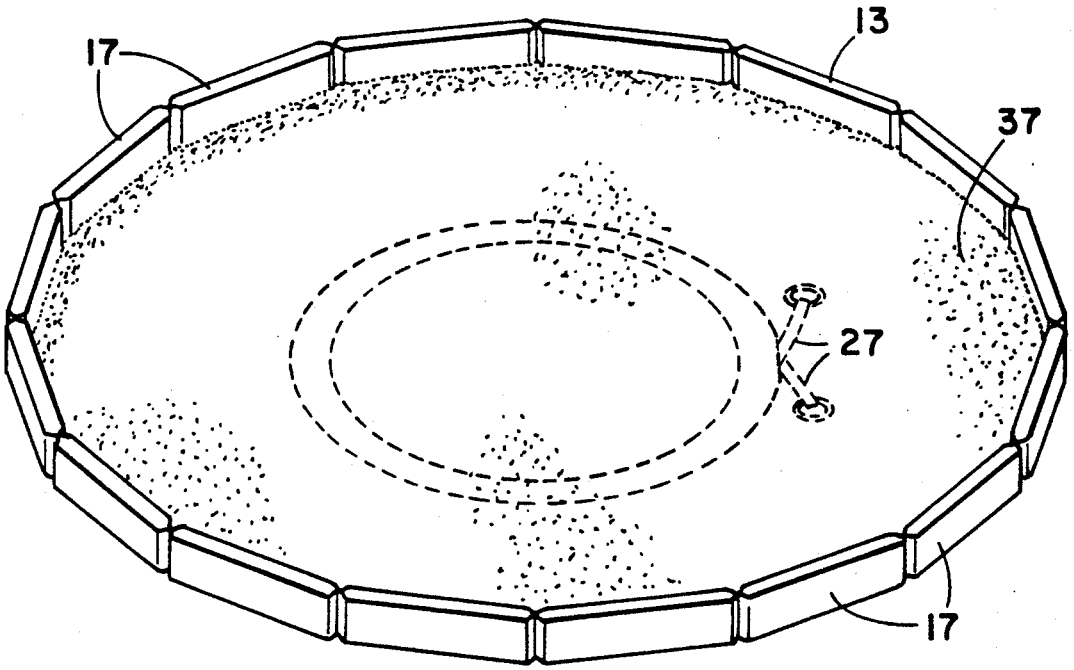
FIG. 2 is a perspective view of the portable sandbox of FIG. 1 with play material dispersed therein.

Turning now to FIG. 2, the portable sandbox of FIG. 1 is shown with a suitable quantity of play material 37, for example sand granules of nontoxic synthetic material or even oatmeal or cheerios, dispersed along the upper surface of the sheet 11 and within the wall 13. As shown in FIG. 2, the play material 37 is dispersed at random in the perimeter of the sandbox. In this ready-for-play condition, the play material 37 will be substantially confined within the perimeter of the sandbox.

Figure 3:
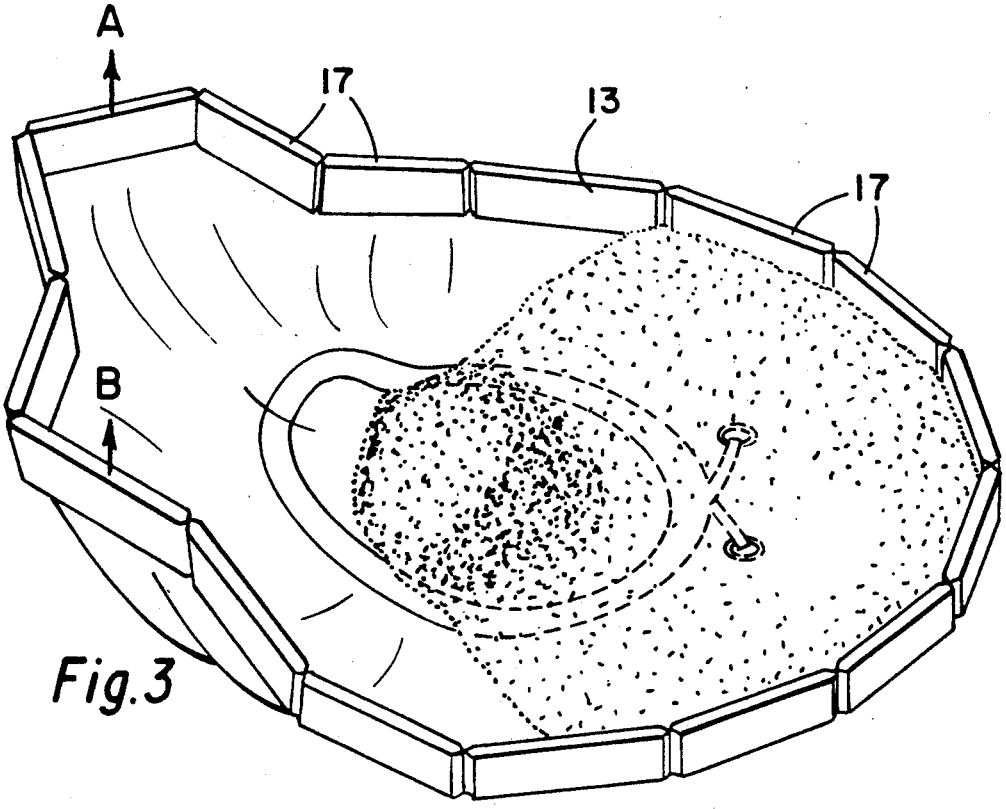
FIG. 3 is a perspective view of the portable sandbox with play material dispersed therein illustrating the gathering of the play material into the central portion of the sandbox.
Figure 4:
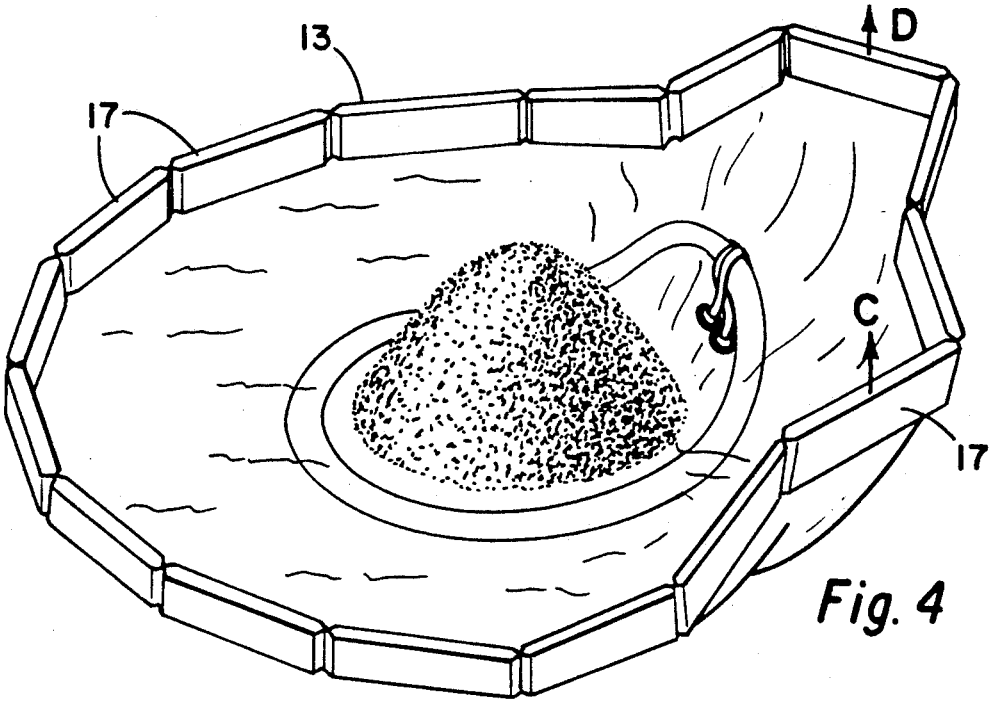
FIG. 4 is a perspective view illustrating the sandbox with the play material fully collected within the central portion of the sandbox.
Figure 5:
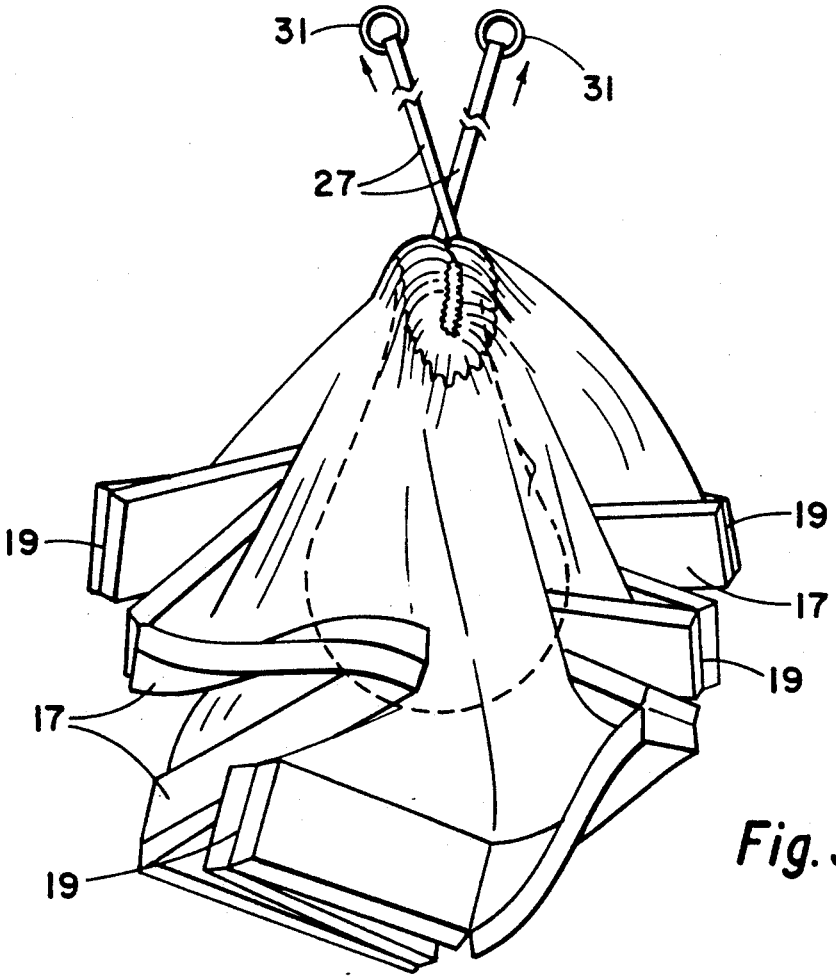
FIG. 5 is a perspective view illustrating the closure of the central portion of the sandbox around the play material and the collapse of the perimeter of the sandbox into the storage condition for future use.

When play is completed, if the sandbox is to be stored, it can be collapsed into its relatively compact storage condition in the simple fashion illustrated in FIGS. 3 through 5. As shown in FIG. 3, the wall 13 can first be raised at position A so as to begin to gather the sand inwardly within the circular strip 21. A similar raising of the wall 13 at position B will further gather the play materials 37 and any toys or other contents of the sandbox into the area defined by the circular strip 21. This process is continued around the perimeter of the sandbox, as shown, for example, at positions C and D in FIG. 4, until all of the play material 37 or any toys or other contents of the sandbox are gathered within the confines of the circular strip 21. With all of the materials gathered together as illustrated in FIG. 4 and with the circular strip raised above the level of the play material 37 and other collected items, the drawstring 25 is pulled to close the interior portion of the sheet 11 and encapsulate the play material 37 and other items to be stored. As can best be seen in FIG. 5, as the sheet 11 is shifted out of its flat condition and as the drawstring closes the interior of the sheet 11 around the play material 37 and other items, the wall 13 collapses along the folds 19 and can be gathered together into a compact condition so that the entire sandbox and its contents can be easily stored in a small area, perhaps after placing the entire sandbox and its contents within a separate duffle bag or the like.

In the preferred embodiment shown, the sheet 11 is circular and the drawstring 25 is arranged in concentric relationship to the sheet 11. However, the sheet may be square, rectangular, ovate or any desired configuration. Similarly, the drawstring path may be of any desired configuration and need not necessarily be centered in the sandbox. Furthermore, the wall panels need not be rectangular. For example, the top edges of the wall may be contoured to provide the child a variety of interesting shapes along the upper surface or even to give the appearance of a fort or castle-like structure. While the drawstring arrangement is illustrated or being guided by the circular strip 21, other means such as a plurality of loops or grommets might also be employed. Preferably, the circular strip 21 will be stitched entirely along its interior edge and substantially entirely along its exterior edge except for the open segment 29 through which the drawstring 25 extends, but the stitching or other bonding may not be continuous. It is further contemplated that mating segments of hook and loop material would be applied on the surfaces of the sheet 11 and the circular strip 21 at the open segment 29 so as to prevent any of the play material 37 from entering into the space between the circular strip 21 and the sheet 11.

It is further desirable that the sheet 11, the casing material of the rectangular members 17, the circular strip 21 and the drawstring 25 or any alternate members, will all be made of machine washable material.

While the portable sandbox has been designed for indoor use, it may be used for outdoor use as well. It is contemplated that the sandbox might be made in a variety of dimensions to accommodate the smallest child in a individual environment as well as to accommodate groups of children in a nursery or school environment.

Thus, it is apparent that there has been provided, in accordance with the invention, a portable sandbox that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A portable sandbox comprising:

a fabric-like sheet;

wall means having a bottom edge thereof fixed along a perimeter of said sheet for standing in substantially vertical relation to said sheet when said sheet is spread in a substantially flat horizontal condition and for collapsing when said sheet is gathered out of said substantially flat horizontal condition; and gathering means disposed substantially along a continuous path on an upper surface of said sheet and inwardly of said perimeter for drawing said continuous path toward confluence.

2. A portable sandbox according to claim 1, corresponding distances across vertically spaced planes passing through said wall being substantially equal to the corresponding distance across said sheet.

3. A portable sandbox according to claim 2, said wall comprising a plurality of rectangular panels disposed in continuous end-to-end relationship with a plurality of vertical folds disposed therebetween.

4. A portable sandbox according to claim 3, said wall further comprising a casing of fabric-like material surrounding said panels and connecting said panels in vertical hingelike fashion at each end-to-end junction.

5. A portable sandbox according to claim 4, said panels being formed of cushion-like material.

6. A portable sandbox according to claim 5, said fabric-like sheet and casing being machine washable.

7. A portable sandbox according to claim 6, said fabric-like sheet and casing being nylon.

8. A portable sandbox according to claim 1, said sheet being circular.

9. A portable sandbox according to claim 1, said gathering means comprising guide means fixed substantially along the length of a continuous path on an upper surface of said sheet and inwardly of said perimeter and drawing means cooperable with said guide means for confluencing said continuous path.

10. A portable sandbox according to claim 9, said continuous path being circular.

11. A portable sandbox according to claim 9, said sheet perimeter and said continuous path being concentric.

12. A portable sandbox according to claim 9, said guide means comprising a layer of fabric-like material covering substantially the length of said continuous path and secured to said sheet at least at intervals on opposite sides of said path and said drawing means comprising a string-like member extending between said guide means and said sheet substantially along the length of said path except for a segment thereof and having ends extending from said segment to be externally accessible in relation to said guide means when said sheet is in said substantially flat horizontal condition.

13. A portable sandbox according to claim 12, said layer being continuously secured to said sheet on opposite sides of said path except at said segment at which said ends of said stringlike member extend externally therefrom.

14. A portable sandbox according to claim 13 further comprising mating pieces of hook and loop material fixed to said sheet and said layer for releasably sealing said segment.

15. A portable sandbox according to claim 12, said stringlike member comprising a strap-like length of fabric-like material.

16. A portable sandbox according to claim 12, said stringlike member having grip means at each end thereof.

17. A portable sandbox according to claim 9, said gathering means being made of machine-washable material.

18. A portable sandbox according to claim 1 further comprising a quantity of sand-like material loosely disposed on said upper surface of said sheet.

19. A portable sandbox according to claim 18, said sand-like material being washable and non-toxic.

20. A portable sandbox comprising:

a fabric-like sheet;

an endless wall having a bottom edge thereof fixed along a perimeter of said sheet, corresponding distances across vertically spaced parallel planes passing through said wall being substantially equal to the corresponding distance across said sheet whereby said wall stands in substantially vertical relation to said sheet when said sheet is spread in a substantially flat horizontal condition, said wall having vertical folds intervally disposed therein whereby said wall collapses when said sheet is gathered out of said substantially flat horizontal condition; and gathering means disposed substantially along the length of a continuous path on an upper surface of said sheet and inwardly of said perimeter for drawing said continuous path toward confluence.

21. A portable sandbox comprising:

a fabric-like sheet;

an endless wall having a bottom edge thereof fixed along a perimeter of said sheet, corresponding distance across vertically spaced parallel planes passing through said wall being substantially equal to the corresponding distance across said sheet whereby said wall stands in substantially vertical relation to said sheet when said sheet is spread in a substantially flat horizontal condition, said wall having substantially vertical folds intervally disposed therein whereby said wall collapses when said sheet is gathered out of said substantially flat horizontal condition;

guide means fixed substantially along the length of a continuous path on an upper surface of said sheet and inwardly of said perimeter; and drawing means cooperable with said guide means for confluencing said continuous path.

* * * * *